US012629743B2

(12) United States Patent
Kofoed Kierstein

(10) Patent No.: US 12,629,743 B2
(45) Date of Patent: May 19, 2026

(54) MODULAR DIE AND METHOD FOR BLANKING A SHEET FOR MANUFACTURING BLANKS, TOOL PARTS FOR SUCH DIE AND USE OF SUCH DIE

(71) Applicant: MENETA HOLDING A/S, Odense (DK)

(72) Inventor: Rune Kofoed Kierstein, Odense (DK)

(73) Assignee: MENETA HOLDING A/S, Odense N (DK)

( * ) Notice: Subject to any disclaimer, the term of this patent is extended or adjusted under 35 U.S.C. 154(b) by 226 days.

(21) Appl. No.: 18/004,885

(22) PCT Filed: Jul. 16, 2020

(86) PCT No.: PCT/DK2020/050217

§ 371 (c)(1),
(2) Date: Jan. 10, 2023

(87) PCT Pub. No.: WO2022/012724

PCT Pub. Date: Jan. 20, 2022

(65) Prior Publication Data

US 2023/0356280 A1 Nov. 9, 2023

(51) Int. Cl.

| | |
|---|---|
| ***B21D 28/02*** | (2006.01) |
| ***B21D 37/04*** | (2006.01) |
| ***B21D 37/10*** | (2006.01) |

(52) U.S. Cl.

CPC ..... *B21D 28/02* (2013.01); *B21D 37/10* (2013.01)

(58) Field of Classification Search

CPC ..... B21D 28/02; B21D 28/04; B21D 28/34; B21D 37/10; B21D 37/04; B21D 37/12; B21D 37/14

See application file for complete search history.

(56) References Cited

U.S. PATENT DOCUMENTS 3,610,021 A * 10/1971 Hopper ..... B21D 37/04 72/470
3,834,217 A * 9/1974 Ducate ..... B21D 37/04 72/462

(Continued)

FOREIGN PATENT DOCUMENTS

DE 2544711 A1 4/1977
DE 37 26 600 A1 4/1988

(Continued)

OTHER PUBLICATIONS

International Search Report mailed on Apr. 12, 2021, in connection with corresponding International Application No. PCT/DK2020/050217; 4 pages.

*Primary Examiner* — Mohammed S. Alawadi
(74) *Attorney, Agent, or Firm* — McCormick, Paulding & Huber PLLC

(57) ABSTRACT

The disclosure relates to a modular die for blanking a sheet for manufacturing individual blanks successively by a stroke of a ram of a press on tool parts for the blanks, the die having frame part (1,2), tool parts (3,4) placed in a gap between the frame part (1,2), where the tool parts (3,4) is maintained in position in the gap (5) by fixation parts (8,9,10,11). The fixation parts (8,9,10,11) engage with lateral surfaces (12, 13,14,15) of the tool parts (3,4). Surfaces of the fixation parts (8,9,10,11) has a geometry congruent with a geometry of lateral surfaces (12,13,14,15) of the tool part (3,4). The disclosure also relates to tool parts of the modular die, to a method for operating the modular die and to a use of the modular die for manufacturing, as example, brake shims.

12 Claims, 3 Drawing Sheets

(56) References Cited

U.S. PATENT DOCUMENTS

| | | | | |
|---|---|---|---|---|
| 3,942,354 | A * | 3/1976 | Randolph, Sr. ..... | B21D 24/02 72/448 |
| 4,397,094 | A | 8/1983 | Nakamura | |

FOREIGN PATENT DOCUMENTS

| | | | |
|---|---|---|---|
| DE | 10 2005 029 060 | B3 | 11/2006 |
| JP | S57-111428 | U | 7/1982 |
| SE | 436100 | B | 11/1984 |

* cited by examiner

MODULAR DIE AND METHOD FOR BLANKING A SHEET FOR MANUFACTURING BLANKS, TOOL PARTS FOR SUCH DIE AND USE OF SUCH DIE

CROSS-REFERENCE TO RELATED APPLICATION

This application is a National Stage application of International Patent Application No. PCT/DK2020/050217, filed on Jul. 16, 2020, which is hereby incorporated by reference in its entirety.

TECHNICAL FIELD

The invention relates to a die for blanking a sheet or strip for manufacturing individual metal blanks, successively, by a stroke or a pressure of a ram of a press on tool parts for the metal blanks, the die comprising a frame lower part for being supported by a lower bed of a press, and a frame upper part for being displaced by the ram of the press. The frame upper part is intended for being displaced by the press ram of the press downwards towards the frame lower part, the frame upper part and the frame lower part guided vertically in relation to each other along frame guide pillars extending from the frame lower part to the frame upper part, and where the die has a tool lower part and a tool upper part placed in a gap between the frame upper part and the frame lower part. The tool parts are capable of being extracted from and inserted into the gap, manually by an operator, and the gap has a position of insertion and extraction of the tool parts.

BACKGROUND

Manufacturing metal blanks is often made by blanking a sheet in a tool part, the tool part having a shape of the metal blank. A tool lower part has to be placed in, aligned and fixed to a press bed and a tool upper part has to be placed in, aligned and fixed to a to a press ram. Blanking is performed by the ram of the press forcing the tool upper part towards a tool lower part, with the sheet in-between the tool part, and when the two tool parts come together, the metal blank is blanked out of the sheet. Blanking is performed continuously, with the sheet being pushed forward into the tool part subsequently to each time a metal blank has been manufactured from the sheet. Placing, aligning and fixing the tool lower part to the press bed and the tool upper part to the press ram takes time. If the tool part has to be exchanged frequently, due to need for manufacturing another type or size of metal blank, each time an exchange is needed, time is spent taking releasing and taking the former tool part out of the presses and placing, aligning and fixing a new tool part in the press. And, each time an exchange of tool part is performed, there is a risk of aligning not being done properly, leading to metal blank not having the right dimensions. The more often an exchange of tool part is needed, the higher is the risk of the tool part not being aligned properly in the press.

To ease exchange of tool part in a press, it is known to have a die, where a frame lower part is fixed to the press bed and a frame upper part is fixed to the press ram, and where the die has separate tool part placed in-between the frame lower part and the frame upper part, and being aligned and fixed in relation to the frame parts, instead fa having to be placed, aligned and fixed to the press bed and the press ram themselves. This type of die provides and easier and faster way of exchanging tool part, but this type of die also limits the risk of the tool part not being aligned properly because of easier and faster placing, alignment and fixing of the tool lower part and the tool upper part to frame parts.

DE 37 26 600 A1 discloses tool parts within frame parts of the die. The set of tool parts is aligned within the frame parts by wedges and a stop. Releasing the fixation part provides a possibility of exchanging the tool parts without having to exchange the frame parts. A new set of tool parts may be inserted, aligned and fixed by the stop bock to the frame parts. DE 37 26 600 A1 still need alignment to be done, both in relation to the side wedges of the die, and in relation to placing the stop in a recess of the frame lower part.

It is an object of the invention to eliminate any need for alignment to be done by an operator exchanging tool parts in the die in order to ensure that errors in alignment occurring during the operator's alignment of the tool parts in the die are eliminated.

It is also an object of the invention to facilitate easier and faster exchange of set of tool parts in order to avoid that the operator exchanging the tool parts because of time constraints does not align the tool parts properly to the bottom and frame upper parts.

SUMMARY

The objects of the invention is obtained by the present invention of a Modular die for blanking a sheet for manufacturing individual blanks successively by a stroke of a ram of a press on tool parts for the blanks, the die comprising

- a frame lower part for being supported by a lower bed of a press, and a frame upper part for being displaced by the ram of the press, and the frame upper part to be displaced by the press ram downwards towards the frame lower part, the frame lower part and the frame upper part guided vertically in relation to each other along frame guide pillars extending between the frame lower part to the frame upper part,
- where the die has at least one tool lower part and at least one tool upper part placed in a gap between the frame lower part and the frame upper part, the tool parts capable of being extracted from and inserted into the gap, and the gap having a position of insertion and extraction of the tool parts,
- where the tool lower part and the tool upper part are void of fixtures extending between the tool parts and the frame parts, when the tool parts are placed in the gap between the frame parts,
- where the tool lower part and the tool upper part, when placed in the gap between the frame parts, is maintained in position in the gap by at least one first fixation part and at least one second fixation part,
- the at least first fixation part provided on one of the frame lower part and frame upper part at a position distant from the position of insertion or extraction of the tool parts into the gap,
- the at least second fixation part provided on one of the frame lower part and frame upper part at a position proximate to the position of introduction or extraction of the tool parts into the gap,
- where part of a first lateral surface of at least one of the tool lower part and the tool upper part has a first selected geometry, and
- where part of a lateral surface of the first fixation part has a geometry congruent with the first selected geometry of the first lateral surface of the tool lower part or the tool upper part, and where part of a second lateral surface of at least one of the tool lower part and the tool upper part has a second selected geometry, and where part of a lateral surface of the second fixation part has a geometry congruent with the second selected geometry of the second lateral surface of the tool lower part or the tool upper part.

The tool upper part and the tool lower part being void of fixtures and only the distant stop and the proximate stop providing alignment and fixture of the tool parts to the frame parts result in an operator of the die, when exchanging tool parts, does not have to operate fixtures between the tool parts and the frame parts.

Not having to operate fixtures results in the advantage of an easier and faster exchange of tool parts, and also results in the advantage of avoiding wrongly or not properly placed tool parts between the frame parts, thereby avoiding that metal blanks manufactured does not have correct dimensions.

A preferred embodiment of the invention is characterised where the tool lower part, when in position on the frame lower part, has a plane lower surface abutting a plane upper surface of the frame lower part, where the tool upper part, when in position towards the frame upper part, has a plane upper surface abutting a plane lower surface of the frame upper part, where the plane surfaces of the tool parts are void of possible fixtures for the plane surfaces of the frame parts, and where the plane surfaces of the frame parts are void of possible fixtures for the plane surfaces of the tool parts.

Plane surfaces of the tool parts and of the frame parts has the advantage of exchange of tool parts being performed by the operator in an easy and fast manner and also results in the advantage of the operator not having to provide, handle and align any fixtures during insertion of the tool parts in the gap between the frame parts.

A further preferred embodiment of the invention is characterised where the at least one second fixation part has one end which is detachable and displaceable in relation to one of the frame lower part and the frame upper part, and has another end which is fixed to one of the frame lower part and the frame upper part, where the at least one second fixation part, when the one end of the second fixation part is detached from the frame part is capable of displacing between a first position, where the at least one second fixation part allows the tool parts to be inserted into, or to be extracted from, the gap between the frame parts, and a second position, where the at least one second fixation part prevents the tool parts from being inserted into, or from being extracted from the gap between the frame parts, and where the at least one second fixation part, when the other end of the fixation part is fixed to the frame part, is maintained in the second position and is prevented from displacing from the second position to the first position.

Displacing the second fixation part between a closed position and an open position, or vice versa, between an open position and a closed position, has the advantage of a quick, easy and reliable insertion and extraction of the tool parts into or from the gap between the frame parts, limiting time and effort of exchanging tool parts.

A possible embodiment of the invention is characterised in that displacing of the at least one second fixation part between the first position and the second position, and vice versa, is a pivoting displacement of the at least one second fixation part in a horizontal plane around a bolt extending through a non-threaded hole in the second fixation part and extending further into a threaded hole in one of the frame lower part and the frame upper part.

An even further preferred embodiment of the invention is characterised, where the fixture for the first fixation part consists of at least two bolts extending through the first fixation part and into threads in the frame part, which the first fixation part is attached to, said at least two bolts for the first fixation part intended for non-releasable fixation of the first fixation part to the frame part, and where the fixture for the second fixation part consists of at least two bolts capable of extending through the second fixation part and into threads in the frame part, which the first fixation part is attached to, the one bolt and the other bolt for the second fixation part, in a closed state of the second fixation part, extending through the second fixation part and into threads in frame part, which the second fixation part is attached to, the one bolt for the second fixation part, in an open state of the second fixation part, extending through the second fixation part and into a thread in the frame part, which the first fixation part is attached to, and constituting a pivot axle for the second fixation part in relation to the frame part, and the other bolt for the second fixation part, in an open state of the second fixation part, does not extend into a thread in frame part to which the second fixation part is attached, allowing the second fixation part to pivot between an open state and a closed state, and vice versa, around the one bolt.

According to an aspect of the invention the tool parts, when placed in the gap between the frame parts, is maintained in position in the gap by at least two first fixation parts and at least two second fixation parts, at least one first fixation part provided on the frame lower part and at least one other first fixation part provided on the frame upper part, all first fixation parts provided at a position distant from the position of insertion or extraction of the tool parts into or from the gap, respectively, and at least one second fixation part provided on the frame lower part and et least one other second fixation part provided on frame upper part, all second fixation parts provided at a position proximate to the position of insertion or extraction of the tool parts into or from the gap, respectively.

A further possible embodiment of the invention is characterised, where the die has a plurality of tool lower parts and a plurality of tool upper parts placed in a gap between the frame lower part and the frame upper part, the tool parts capable of being extracted from and inserted into the gap, and the gap having a position of insertion and extraction of the tool parts, where the tool lower parts and the tool upper parts, when placed in the gap between the frame parts, is maintained in position in the gap by at least one first fixation part and at least one second fixation part, and where each of the at least one first fixation part and each of the at least one second fixation part, along the lateral surfaces of the fixation means and the lateral surfaces of the tool parts, respectively, is fixating at least two sets of tool parts in the gap between the die plates.

According to a preferred aspect of the invention the first selected geometry of the first lateral surface of at least one of the tool lower part and the tool upper part is identical to the second selected geometry of the second lateral surface of at least one of the tool lower part and the tool upper part.

According to an alternative aspect of the invention the first selected geometry of the first lateral surface of at least one of the tool lower part and the tool upper part is different from the second selected geometry of the second lateral surface of at least one of the tool lower part and the tool upper part.

An even still further preferred embodiment of the invention is characterised, where the position of insertion of the tool parts into the gap is the same as the position of extraction of the tool parts from the gap, and where the geometry of the at least one first fixation part is selected from the following geometries: a convex surface or a concave surface, where the geometry of part of the first lateral surface of at least one of the tool upper part or the tool lower part is selected from the following geometries: a concave surface, or a convex surface, so that the tool parts at the distant position is fixed to the frame part at least in a direction along a direction of insertion into or extraction from the gap between the frame upper part and the frame lower part, and where the geometry of the at least one second fixation part is selected from the following geometries: a convex surface or a concave surface, where the geometry of part of the second lateral surface of at least one of the tool upper part or the tool lower part is selected from the following geometries: a concave surface or a convex surface, so that the tool parts at the proximate position is fixed to the frame part both in a direction along, and in a direction transverse to, a direction of insertion into or extraction from the gap between the frame upper part and the frame lower part.

An advantageous embodiment of the invention is characterised, where the die comprises a linear safety pillar capable of extending between the frame upper part and the frame lower part, and the safety pillar capable of being applied to the die and capable of being left out of the die, by choice of an operator, the safety pillar, when applied to the die, extending between the frame upper part end the frame lower part, the safety pillar, when applied to the die, operating a stop pin, preventing the stop pin from entering into a corresponding hole in the at least one second fixation part, allowing the tool parts to be inserted into, or to be extracted from, the gap between the frame parts, the safety pillar, when not applied, not operating the stop pin, allowing the stop pin entering into the corresponding hole in the at least one second fixation part, preventing the tool parts to be inserted into, or to be extracted from, the gap between the frame parts, and where the safety pillar is intended for being applied, by an operator, when the tool parts are to be inserted into, or are to be extracted from, the gap between the frame parts, and the safety pillar intended for being left out during manufacture of blanks in the die.

A further advantageous embodiment of the invention is characterised, where the stop pin is biased, by a resilient element, towards a position, where the stop pin extends into the corresponding hole in the at least one second fixation means, and where the safety pillar, when applied to the die, biases the stop pin against the biasing by the resilient element with a force larger than a biasing force of the resilient element.

The object of the invention is further obtained by a tool lower part and a tool upper part for a die for blanking sheets so as to form individual work pieces successively by a stroke of a ram of a press, where part of lateral surfaces of at least one of the tool lower part and the tool upper part having a convex geometry, alternatively having a concave geometry, where the part of each of the lateral surfaces is capable of and intended for engaging with a surface of a fixation part attached to a frame part of the die, where the convex geometry, alternatively the concave geometry, of each of the lateral surfaces of the tool parts is congruent with and complementary to a concave geometry, alternatively a convex geometry, respectively, of the surfaces the fixation part attached to the frame part.

The object of the invention is also obtained by a method for blanking sheets so as to form individual blanks successively by a stroke of a ram of a press, blanking being performed by a die comprising a frame lower part for being supported by a lower press plate of a press, and a frame upper part for being attached to a press ram of the press, and the frame upper part to be displaced by the press ram downwards towards the frame lower part, and the frame lower part and the frame upper part guided vertically in relation to each other along frame guide pillars extending between the frame lower part and the frame upper part, where the die has a tool lower part and a tool upper part to be placed in a gap between the frame lower part and the frame upper part, the gap having a position of insertion of the tool parts and a position of extraction of the tool parts, the method comprising the steps of:

if the at least one second fixation part is in a first closed position, then displacing the at least one second fixation part from a closed first position to an open second position, or if the at least one second fixation part is in an open second position, then maintaining the at least one second fixation part in the open second position, inserting the tool parts into the gap between the frame parts, insertion being performed by sliding a plane lower surface of the tool lower part along a plane upper surface of the frame lower part, establishing an abutment between part of a first lateral surface of at least one of the tool parts and a first fixation part attached to least one of the frame parts, abutment preventing further sliding of the tool parts into the gap, displacing the at least one second fixation part from the open second position to the closed first position and establishing an abutment between part of a convex of concave second lateral surface of at least one of the tool parts and a concave or convex lateral surface of the second fixation part attached to at least one of the frame parts, abutment preventing sliding of the tool parts out of the gap, and said lateral surface of the at least one second fixation part corresponding to and being congruent with the lateral surface of at least one of the tool parts, fixing the at least one second fixation part to at least one of the frame parts, preventing the at least one second fixation part from displacing from the closed second position to the open first position.

The object of the invention is also obtained by use of a die according to the invention for manufacturing one of the following blanks: a brake shim, a gasket.

DETAILED DESCRIPTION

Figure 1:
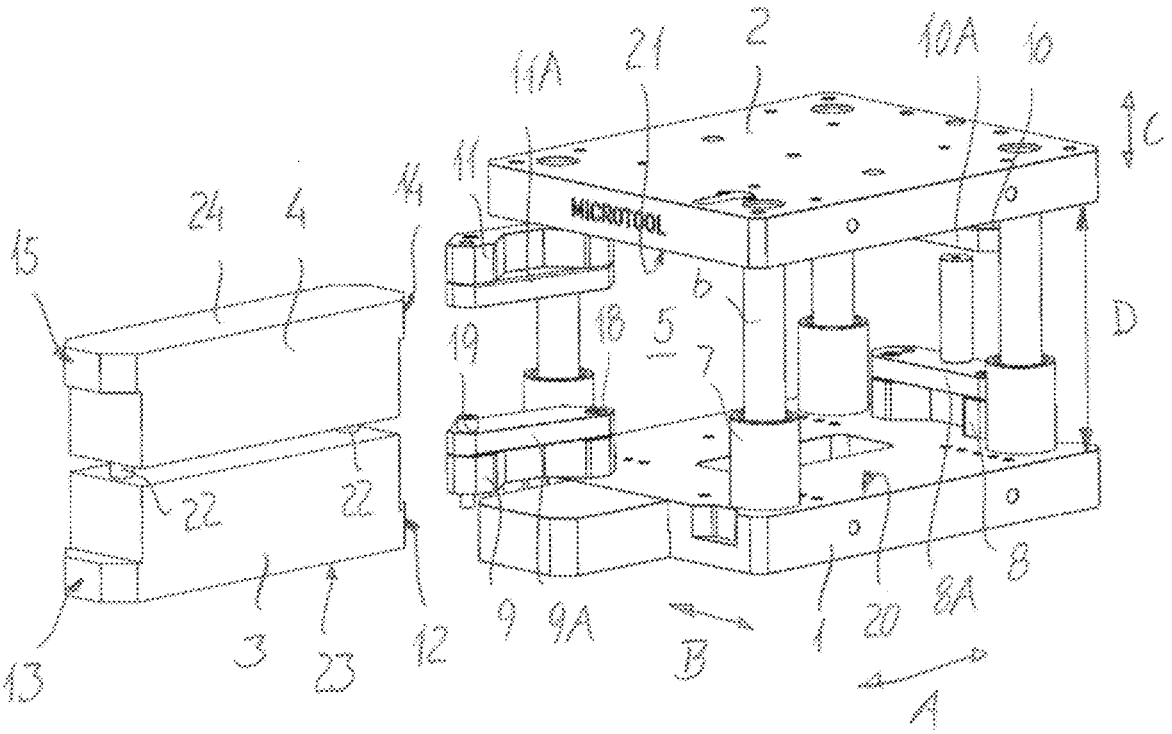
FIG. 1 shows in perspective an embodiment of the die in an open state.
Figure 2:
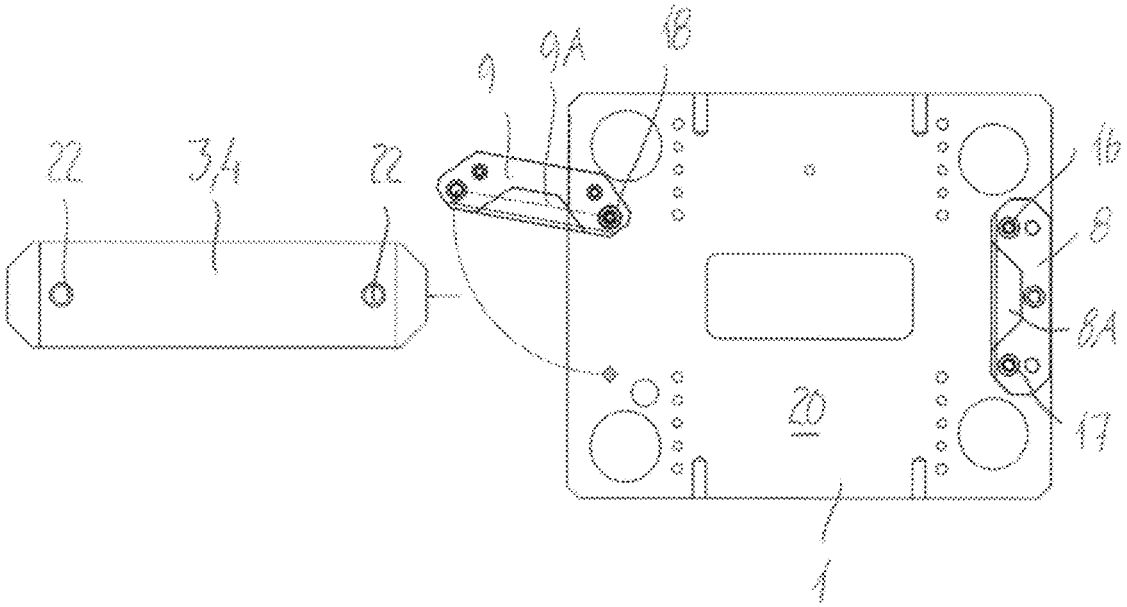
FIG. 2 shows a plane view the embodiment of the die in an open state.

FIG. 1 and FIG. 2 show a die comprising a frame lower part 1 and a frame upper part 2. A tool lower part 3 and a tool upper part 4 are situated outside a gap 5 between the frame lower part 1 and the frame upper part 2. The tool parts 3,4 are intended for being positioned in the gap 5 (see FIG. 3 and FIG. 4). The frame lower part 1 is intended for being placed on a press die bed (not shown) of a press and the frame upper part 2 is intended for being attached to a die press ram (not shown) of the press and intended for being displaced downwards towards the frame lower part 1 by the die press ram of the press.

In FIG. 1 and FIG. 2, the tool parts 3,4 are positioned outside the gap 5, ready to be inserted into the gap 5 between the frame parts 1,2 and to be fixed inside the gap 5.

The frame parts 1,2 are kept at a distance D in relation to each other along frame guide pillars 6 extending between the frame parts 1,2. The maximal distance, and therefore the maximum size of the gap 5, between the frame parts 1,2 are dependent on the length of the frame guide pillars 6. A bottom end of each of the frame guide pillars 6 are located in a guide pillar bushing 7. The frame guide pillars 6 are capable of being displaced downwards by the press ram, together with the frame upper part 2, along the guide pillar bushings 7, and into the frame lower part 1, thereby decreasing the size of the gap 5.

Each of the frame lower part 1 and the frame upper part 2 are provided with two first fixation parts 8,10 at one end of the frame parts 1,2 and two second fixation parts 9,11 at another end, opposite to the one end, of the frame parts 1,2. The first fixation parts 8,10 are provided at a position distant from a position of insertion or extraction of the tool parts 3,4 into or from the gap 5. The second fixation parts 9,11 are provided at a position proximate to the position of insertion or extraction of the tool parts 3,4.

The first fixation parts 8, 10 are in a fixed position at one end of the frame parts 1,2. The second fixation parts 9,11 are also in a fixed position at the other end of the frame parts 1,2, but the second fixation parts 9,11 are capable of pivoting in a horizontal plane between an open position, shown in FIG. 1 and FIG. 2, and a closed position, shown in FIG. 3 and FIG. 4. When the second fixation parts 9,11 are in the open position, the tool parts 3,4, if the tool parts 3,4 are not yet inserted into the gap 5, may be inserted into the gap 5, or, if the tool parts 3,4 already are situated in the gap 5, the tool parts 3,4 may be extracted from the gap 5.

In the embodiment shown of the die, a geometry of each of the first fixation parts 8,10 and each of each of the second fixation parts 9,11 are the same. The geometry of each of the first fixation parts 8,10 and of the second fixation parts 9,11 comprises a concave having a trapezoidal shape intended for holding corresponding convex lateral surfaces 12,13 of the tool lower part 3 and corresponding convex lateral surfaces 14,15 of the tool upper part 4, respectively, in a lengthwise direction A and a transverse direction B.

Each of the first fixation parts 8,10 and each of the second fixation parts 9,11 have fixation part caps 8A,9A, 10A, 11A for holding the corresponding lateral surfaces 12-15 of the tool parts 3,4 in a vertical direction C. The caps 8A,9A ensure that the tool lower part 3 is maintained laterally to the frame lower part 1, and the caps 10A, 11A ensure that the tool upper part 4 is maintained to the frame upper part 2, also when the frame upper part 1 is displaced upwards, which is when the pressure of the press ream is released.

Each of the tool lower part 3 and the tool upper part 4 is provided with a first lateral surface 12,14 at one end of the tool parts 3,4 and a second lateral surface 13,15 at another end, opposite to the one end, of the tool parts 3,4. A geometry of each of the first lateral surfaces 12,14 are complementary to, and congruent with, a geometry of each of the first fixation parts 8,10, and a geometry of each of the second lateral surfaces 13,15 are complementary to, and congruent with, a geometry of each of the second fixation parts 9,11. In the embodiment shown, the geometry of each of the first lateral surfaces 12,14 is identical to the geometry of each of the first lateral surfaces 12,14. In other embodiments, the geometry of each of the first lateral surfaces 12,14 is different to the geometry of each of the first lateral surfaces 12,14.

Each of the first fixation parts 8,10 are permanently fixed to the frame parts 1,2 by two bolts 16,17 (also see FIG. 3-6) provided at one end and at another opposite end, respectively, of each of the first fixation parts. Each of the second fixation parts 9,11 are realisably fixed to the frame parts 1,2 by two bolts 18,19 provided at one end and at another opposite end, respectively, of each of the second fixation parts. The one bolt 18 constitutes a pivot axle in the frame upper part 1 or the frame lower part 2 for the second fixation parts 9,11, and the other bolt 19 is releasable and fixable to the frame upper part 1 or the frame lower part 2, by choice of an operator, to allow or to prevent, the second fixation parts 9,11 to be pivoted in the horizontal plane around the one bolt 18.

The one bolt 18 constituting a pivot axle is a so-called head/shoulder bolt capable of providing a fit in a corresponding bolt hole (not shown) in the frame upper part 2, with a tolerance, when fitted, being adequate for obtaining a good fit between the concave geometry of the fixation part 11 and the convex lateral surface 14 of the tool upper part 4. Other types of pivot axle than a head/shoulder bolt may be used instead.

An upper surface 20 of the frame lower part 1 and a lower surface 21 of the frame upper part 2 are plane and are void of any protruding elements, such as bolts, pins or guides, for holding the tool parts 3,4 to the frame lower part 1 and the frame upper part 2, respectively.

As is the case with the frame upper part 2 and the frame lower part 1, the tool lower part 3 and the tool upper part 4 are capable of being displaced towards each other by the tool upper part 4 being pressed towards the tool lower part 3.

And as is the case with the frame upper part 2 and the frame lower part 1, the tool lower part 3 and the tool upper part 4 are guided in relation to each other along tool part guide pillars 22 extending between the tool lower part 3 and the tool upper part 4.

A lower surface 23 of the tool lower part 3 and an upper surface 24 of the tool upper part 4 are plane and void of any protruding elements, such as bolts, pins or guides, for holding the tool parts 3,4 to the frame lower part 1 and the frame upper part 2, respectively.

Accordingly, fixing the tool parts 3,4 to the frame parts 1,2 is only performed by the first lateral surfaces 12,13 of the tool lower part 3,4 engaging with the first fixation parts 8,10 and the second lateral surfaces 14,15 of the tool upper part 3,4 engaging with the second fixation parts 10,11.

Insertion of the tool parts 3,4 into the gap 5 between the frame parts 1,2 is performed as here described: The second fixation parts 9,11, if in a closed position, is pivoted around the one bolt to put the second fixation parts 9,11 in an open position. When the second fixation parts 9,11 are in the open position, the tool parts 3,4 are inserted into the gap 5 between the frame parts 1,2, insertion being performed by sliding the lower surface 16 of the tool lower part 3 along the upper surface 16 of the frame lower part 1.

Each of the first lateral surfaces 12,14 of the tool parts 3,4 are brought into engagement with the first fixation parts 8,10 of each of the frame parts 1,2. Each of the second fixation parts 9,11 are then pivoted from the open position to the closed position, thereby engaging with the second lateral surfaces 13,15 of the tool parts 3,4. Thereby, the tool upper part 4 is fixed to the frame upper part 2 and the tool lower part 3 is fixed to the frame lower part 1.

Extraction of the tool parts 3,4 from the gap 5 between the frame parts 1,2 is performed as here described: The second fixation parts 9,11 of the frame lower part 1 and the frame upper part 2 are pivoted around the one bolt, to put the second fixation parts 9,11 in an open position. When the second fixation parts 9,11 are in the open position, the second fixation parts 9,11 are disengaged from the second lateral surfaces 13,15 of the tool parts 3,4. The tool parts 3,4 are then pulled from the gap 5 between the frame parts 1,2 by sliding the lower surface 18 of the tool lower part 3 along the upper surface 16 of the frame lower part 1. When the tool parts 3,4 are pulled from the gap 5, the first lateral surfaces 12,14 of the tool parts 3,4 are brought out of engagement with the first fixation parts 8,10 of each of the frame parts 1,2, and the tool lower part 3 and the tool upper part 4 are no longer fixed to the frame lower part 1 and the frame upper part 2, respectively.

Fixation of the tool parts 3,4 to the frame parts 1,2 is only performed by the lateral surfaces 12-15 of the tool parts 3,4 engaging with the fixation parts 8-11. No fixation is performed directly between the upper surface 16 of the frame lower part 1 and the lower surface 18 of the tool lower part 3 and no fixation is performed between the lower surface of the frame upper part 2 and the upper surface 17 of the tool upper part 4. Fixation between the frame lower part and the tool lower part and between the frame upper part and the tool upper part is only performed by means of the fixation parts 8,10,9 and the lateral surfaces 11,12.

Thus, no obstructions are present when sliding the tool parts 3,4 in and out of the gap 5 between the frame parts 1,2 during insertion and extraction of the tool parts 3,4.

Figure 3:
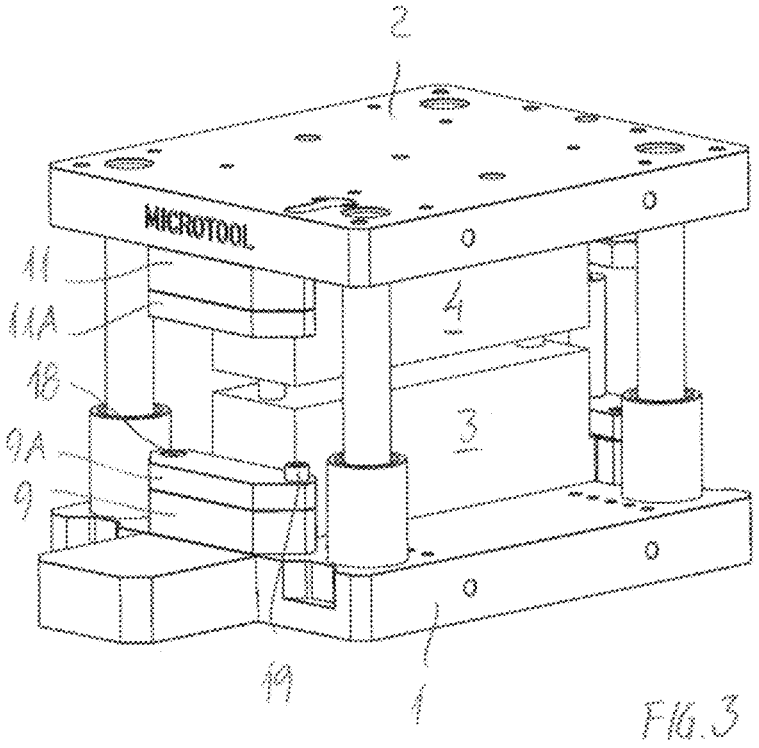
FIG. 3 shows in perspective the embodiment of the die in a closed state.
Figure 4:
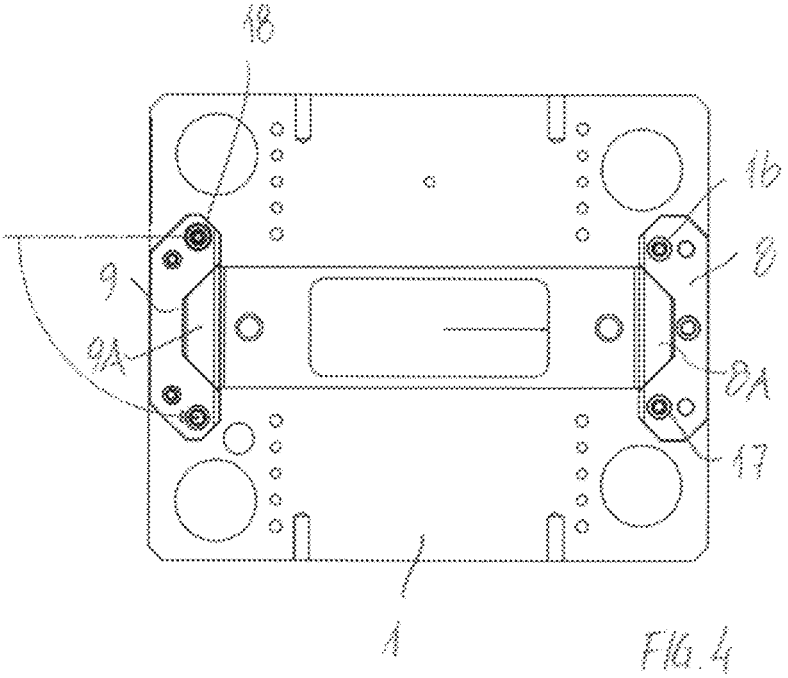
FIG. 4 shows in a plane view the embodiment of the die in a closed state.

FIG. 3 and FIG. 4 also show the die comprising the frame lower part 1 and the frame upper part 2 together with the tool lower part 3 and the tool upper part 4. However, the tool lower part 3 and the tool upper part 4 are now situated in the gap 5 between the frame lower part 1 and the frame upper part 2, ready for manufacture of blanks.

The tool parts 3,4 are fixed to the frame lower part 1 and the frame upper part by the first fixation parts 8,10 holding the first lateral surfaces 12,14 of the tool parts 3,4 and the second fixation parts 9,11 holding the second lateral surfaces 13,15 of the tool parts 3,4. The second fixation parts 9,11 are in the closed position, where the first fixation parts 8,10 are in engagement with the first lateral surfaces 12,14 of the tool parts 3,4, and where the second fixation parts 9,11 are in engagement with the second lateral surfaces 13,15 of the tool parts 3,4. The tool parts 3,4 are hereby fixed, both in a horizontal direction and in a vertical direction in relation to the frame lower part 1 and the frame upper part 2.

When the frame upper part 2 is pressed towards the frame lower part 1 by the press ram, the tool upper part 4 is pressed towards the tool lower part 3. When a metal strip is placed between tool parts 3,4, the tool parts 3,4 produce a blank having a shape corresponding to a shape of blank edge circumferences of the tool parts 3,4. When the blank has been produced, the press ram is released and the frame upper part 2 together with the tool upper part 4 is displaced away from the frame lower part 1 and the tool lower part 3. The blank produced is outputted along with a displacement of the strip, or the blank produced is outputted through a hole in the tool lower part 3.

When the press ram is released from pressing the frame upper part 2 towards the frame lower part 1, the frame upper part 2 together with the tool upper part 4 displaces upwards in relation to the frame lower part 1. When the frame upper part 2 displaces upwards, the tool upper part 4 displaces together with the frame upper part 2 because of engagement between the first and second fixation parts 10,11 of the frame upper part 2 and the first and second lateral surfaces 14,15 of the tool upper part 4. The tool lower part 3 remains fixed to the frame lower part 1 because of engagement between the first and second fixation parts 8,9 of the frame lower part 1 and the first and second lateral surfaces 12,13 of the tool lower part 3.

In the embodiment shown in FIG. 3-4, one set of tool parts 3,4 is shown situated between the frame parts. In an alternative embodiment, two or perhaps more sets of tool parts may be provided in the gap between the frame parts. By providing two or more sets of tool parts, either more than one blank may be produced at the same time, each time the press ram forces the frame upper part towards the frame lower part, or different blanks having different sizes and/or shapes may be produced at the same time, each time the press ram forces the frame upper part towards the frame lower part.

In the alternative embodiment of two or more sets of tool parts being provide in the gap between the frame parts, either at least one first fixation part and at least one second fixation part is provided for each of the two or more sets of tool parts for fixing the tool parts to the frame parts, or at least one first fixation part and at least one second fixation part is capable of fixing two or more sets of tool parts to the frame parts, or two or more first fixation parts and two or more second fixation part is provided, each of the fixation parts capable of fixing two or more sets of tool parts to the frame parts.

Figure 5:
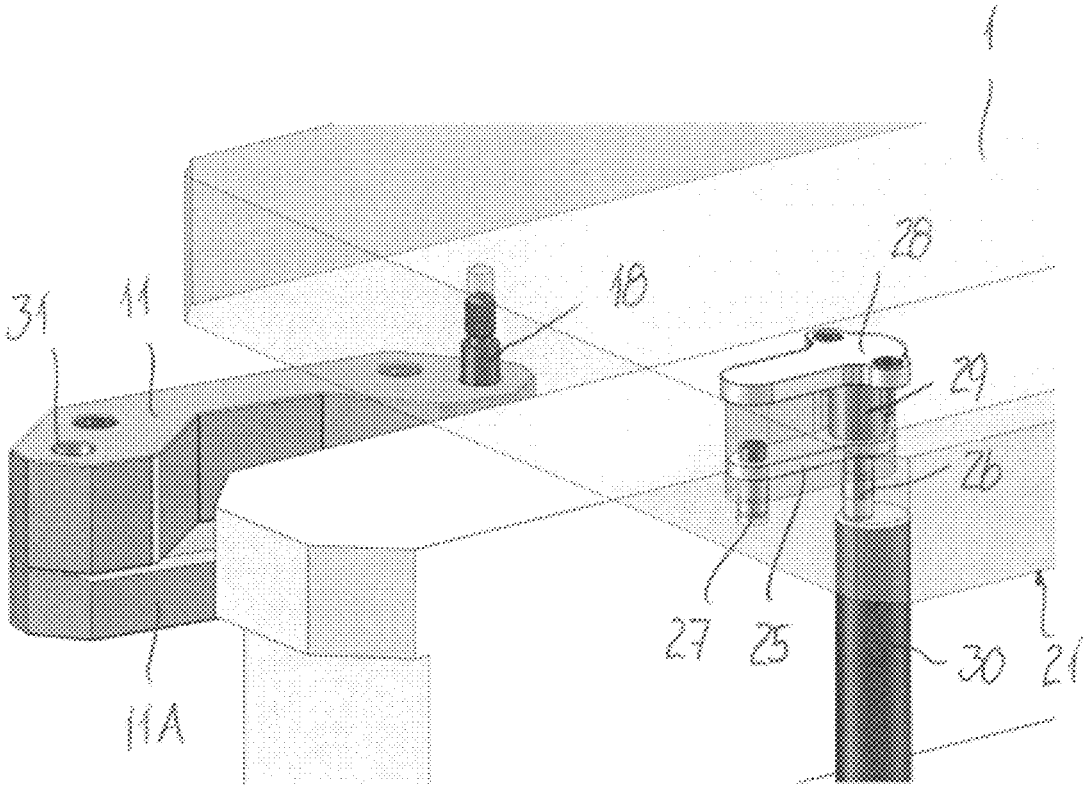
FIG. 5 shows an embodiment of a locking mechanism together with an embodiment of a safety mechanism, with the die in an open state.

FIG. 5 shows a safety mechanism with the die in an open state. The safety mechanism prevents the frame 1,2 from displacing towards each other, when the tool parts 3,4 are inserted into, and extracted from, the gap 5 between the frame parts 1,2. Preventing the frame parts 1,2 tool parts 3,4 from displacing towards each other during insertion and extraction of the tool parts 3,4 and prevents an operator of accidently having fingers or hands squeezed between the tool parts 3,4, when inserting and extracting the tool parts 3,4.

The safety mechanism comprises a pin retainer plate 25 having a first pin 26 attached at one end of the pin retainer plate 25 and a second pin 27 attached to another end of the pin retainer plate 25. The pin retainer plate 25 is embedded in the lower surface 21 of the frame upper part 2. A cap 28 is provided at an upper surface of the frame upper part 2. A biasing resilient element 29, as example a helical spring, is embedded within the frame upper part 2, between the pin retainer plate 25 and the cap 28. The resilient element 29 biases the pin retainer plate 25 downwards, to bias the first pin 26 and the second pin 27 downwards, for the second pin 27 to lock an upper second stop element 11 in a closed position.

In FIG. 5, the second pin 27 is in an upwards position, enabling the upper second fixation part 11 to pivot in a horizontal plane around the one bolt 18 in the frame upper part 2. The lower second stop element (see FIG. 1-4) is also capable of pivoting in a horizontal plane around a corresponding one bolt (see FIG. 1-4) in the frame lower part 1 (see FIG. 1-4), but is not locked with a second pin 27 as the upper second fixation part 11 is. Thus, only the upper second fixation part 11 is engaging with a second pin 27 and operating with the safety mechanism.

The second pin 27 being in an upwards position, although being biased by the resilient element 29 towards a downwards position, is obtained by a safety pillar 20 having been inserted by an operator into the gap 5 between the upper surface 20 the frame lower part 1 and the lower surface 21 of the frame upper part 2. A bottom end (not shown) of the safety pillar 30 is inserted in a hole in the frame lower part 1, and a top end of the safety pillar 30 is abutting the first 26 pin of the safety mechanism.

The safety pillar 30 has a length, which is larger than a height of the tool parts 3,4 in a non-compressed state. When the safety pillar 30 is inserted between the frame lower part 1 and the frame upper part 2, the gap 5 between the frame lower part 1 and the frame upper part 2 cannot be less than the height of the tool parts 3,4 in a non-compressed state.

Thereby, when the safety pillar 30 is inserted between the frame lower part 1 and the frame upper part 2, the tool parts 3,4 can be inserted and extracted without a risk of the frame parts 1,2 tool part 3,4 squeezing the tool parts 3,4 toward each other, and without the risk of an operator squeezing fingers or hands between the frame parts 1,2 and the tool parts 3,4, or between the tool part 3,4 themselves, when inserting or extracting the tool parts 3,4.

The safety pillar 30 also biases the first pin 26 upwards against the downwards biasing force of the resilient element 29. Thereby, the pin retainer plate 25 and the second pin 27 is also biased upwards against the downwards biasing force of the resilient element 29. The second pin 27 is biased upwards a distance resulting in a tip of the second pin 27 being embedded within the frame upper part 1, not extending outside the lower surface 21 of the frame upper part 2. Thereby, the upper second fixation part 11 may pivot freely from an open position to a closed position, when having to insert of the tool parts 3,4 into the gap 5 between the frame parts 1,2, and freely from a closed position to an open position, when having to extract the tool parts 3.4 from the gap 5 between the frame parts 1,2.

Figure 6:
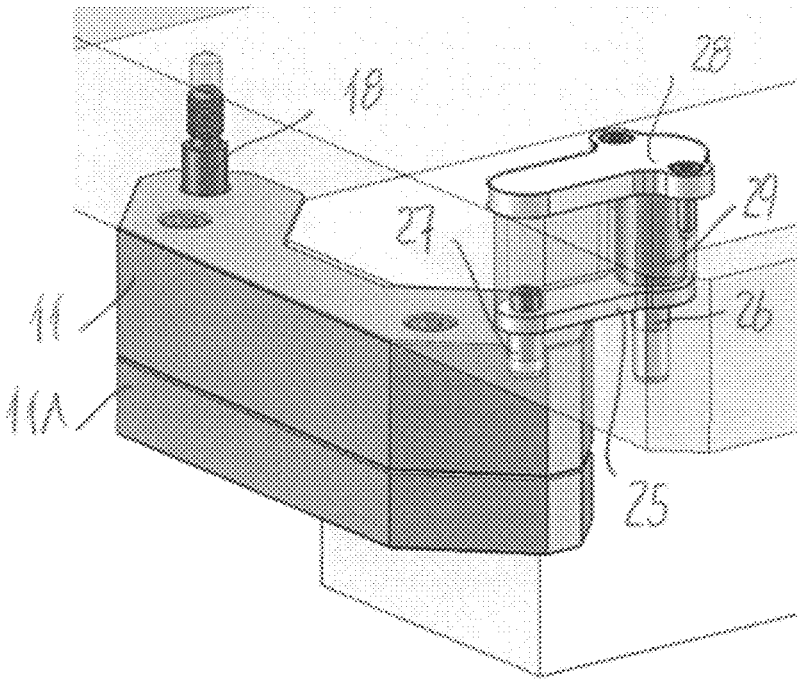
FIG. 6 shows the locking mechanism, with the die in a closed state.

FIG. 6 shows the die in an open state with the die in a closed state, and without the safety pillar 30 inserted in the gap 5 between the frame parts 1,2.

In FIG. 6, the second pin 27 is in a downwards position. The tip of the second pin 27 is in engagement with an outer surface of the upper second stop element 11, Alternatively, the tip of the second pin 27 may be in engagement with an upper corresponding recess 31, such as a hole, provided in the upper second fixation part 11. The tip of the second pin 27 engaging a surface or a recess of the upper second stop element 11 prevents the upper second stop element 11 from pivoting in a horizontal plane around the one bolt 18 in the frame upper part 1. The lower second stop element 9 is also prevented from pivoting in a horizontal plane around the corresponding bolt (not shown) in the frame lower part 1 (not shown), however by another bolt 19 (see FIG. 3) inserted manually by an operator.

When the safety pillar 30 is not inserted between the frame lower part 1 and the frame upper part 2, the tool parts 3,4 are capable of being displaced towards each other, after the tool parts 3,4 have been inserted in the gap 5 between the frame parts 1,2, the tool parts 3,4 ready for manufacture of blanks by the press operating the frame upper part 2.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A modular die for blanking a sheet configured for manufacturing individual blanks successively by a stroke of a ram of a press on at least one tool lower part and at least one tool upper part for the blanks, the die comprising:

a frame lower part configured for being supported by a lower bed of a press, and a frame upper part configured for being displaced by the ram of a press, and the frame upper part configured for being displaced by the ram of the press downwards towards the frame lower part, the frame lower part and the frame upper part guided vertically in relation to each other along frame guide pillars extending between the frame lower part and the frame upper part;

wherein the die has at least one tool lower part and at least one tool upper part placed in a gap between the frame lower part and the frame upper part, the at least one tool lower part and the at least one tool upper part capable of being extracted from and inserted into the gap, and the gap having a position of insertion and extraction of the at least one tool lower part and the at least one tool upper part;

wherein the at least one tool lower part and the at least one tool upper part are void of fixtures extending between the at least one tool lower part and the at least one tool upper part and the frame lower part and the frame upper part, respectively, when the at least one tool lower part and the at least one tool upper part are placed in the gap between the frame lower part and the frame upper part;

wherein the tool lower part and the tool upper part, when placed in the gap between the frame lower part and the frame upper part, is maintained in a position in the gap by at least one first fixation part and at least one second fixation part;

the at least one first fixation part provided on one of the frame lower part and frame upper part at a position distant from the position of insertion or extraction of the at least one tool lower part and the at least one tool upper part;

the at least one second fixation part provided on one of the frame lower part and frame upper part at a position proximate to the position of introduction or extraction of the at least one tool lower part and the at least one tool upper part into the gap;

wherein part of a first lateral surface of at least one of the tool lower part and the tool upper part has a first selected geometry; and wherein part of a lateral surface of the at least first fixation part has a geometry congruent with the first selected geometry of the first lateral surface of the tool lower part or the tool upper part; and wherein part of a second lateral surface of at least one of the tool lower part and the tool upper part has a second selected geometry;

wherein part of a lateral surface of the at least second fixation part has a geometry congruent with the second selected geometry of the second lateral surface of the tool lower part or the tool upper part;

wherein the at least one second fixation part has one end which is detachable and displaceable in relation to one of the frame lower part and frame upper part, and has another end which is fixed to one of the frame lower part and frame upper part;

wherein the at least one second fixation part, when the one end of the second fixation part is detached from the one of the frame lower part and frame upper part is capable of displacing between:

a first position, wherein the at least one second fixation part allows the at least one tool lower part and the at least one tool upper part to be inserted into, or to be extracted from, the gap between the frame lower part and frame upper part; and a second position, wherein the at least one second fixation part prevents the at least one tool lower part and the at least one tool upper part from being inserted into, or from being extracted from the gap between the frame lower part and frame upper part, and wherein the at least one second fixation part, when the other end of the fixation part is fixed to one of the frame lower part and frame upper part, is maintained in the second position and is prevented from displacing from the second position to the first position.

2. The modular die according to claim 1, wherein the tool lower part, when in position on the frame lower part, has a plane lower surface abutting a plane upper surface of the frame lower part;

wherein the tool upper part, when in position towards the frame upper part, has a plane upper surface abutting a plane lower surface of the frame upper part;

wherein the plane lower surface and the plane upper surface of the tool lower part and the tool upper part, respectively, are void of fixtures for the plane surfaces of the frame upper part and the frame lower part; and wherein the plane lower surface and the plane upper surface of the frame lower part and the frame upper part, respectively, are void of fixtures for the plane lower surface and the plane upper surface of the tool lower part and the tool upper part, respectively.

3. The modular die according to claim 1, wherein displacing of the at least one second fixation part between the first position and the second position, and vice versa, is a pivoting displacement of the at least one second fixation part in a horizontal plane around a bolt extending through a non-threaded hole in the second fixation part and extending further into a threaded hole in one of the frame lower part and frame upper part.

4. The modular die according to claim 3, wherein the fixture for the at least one first fixation part consists of at least two bolts extending through the at least one first fixation part and into threads in one of the frame lower part and frame upper part, which the at least one first fixation part is attached to, said at least two bolts for the at least one first fixation part intended for non-releasable fixation of the at least one first fixation part to one of the frame lower part and frame upper part, and wherein the fixture for the at least one second fixation part consists of at least two bolts capable of extending through the at least one second fixation part and into threads in one of the frame lower and frame upper part, which the at least one second fixation part is attached to, the one bolt and the other bolt for the at least one second fixation part, in a closed state of the at least one second fixation part, extending through the at least one second fixation part and into threads in one of the frame lower part and frame upper part, which the at least one second fixation part is attached to, the one bolt for the at least one second fixation part, in an open state of the at least one second fixation part, extending through the at least one second fixation part and into a thread in one of the frame lower part and frame upper part, which the at least one second fixation part is attached to, and constituting a pivot axle for the at least one second fixation part in relation to one of the frame lower part and frame upper part, and the other bolt for the at least one second fixation part, in an open state of the at least one second fixation part, does not extend into a thread in one of the frame lower part and frame upper part to which the at least one second fixation part is attached, allowing the at least one second fixation part to pivot between an open state and a closed state, and vice versa, around the one bolt.

5. The modular die according to claim 1, wherein the at least one tool lower part and the at least one tool upper part, when placed in the gap between the frame lower part and frame upper part, is maintained in position in the gap by at least two first fixation parts and at least two second fixation parts;

at least one of the first fixation part provided on the frame lower part and at least other of the first fixation part provided on the frame upper part, wherein the at least two first fixation parts provided at a position distant from the position of insertion or extraction of the at least one tool lower part and the at least one tool upper part into or from the gap, respectively; and at least one of the second fixation part provided on the frame lower part and at least other of the second fixation part provided on frame upper part, wherein the at least two second fixation parts provided at a position proximate to the position of insertion or extraction of the at least one tool lower part and the at least one tool upper part into or from the gap, respectively.

6. The modular die according to claim 1, wherein the die has a plurality of tool lower parts and a plurality of tool upper parts placed in a gap between the frame lower part and the frame upper part, the plurality of tool lower parts and tool upper parts capable of being extracted from and inserted into the gap, and the gap having a position of insertion and extraction of the plurality of tool lower parts and tool upper parts;

wherein the tool lower parts and the tool upper parts, when placed in the gap between the frame lower part and the frame upper part, is maintained in position in the gap by at least one first fixation part and at least one second fixation part; and wherein each of the at least one first fixation part and each of the at least one second fixation part, along the lateral surfaces of the fixation means and the lateral surfaces of the plurality of tool lower parts and tool upper parts, respectively, is fixating at least two sets of tool lower parts and tool upper parts in the gap between the die plates.

7. The modular die according to claim 1, wherein the first selected geometry of the first lateral surface of at least one of the tool lower part and the tool upper part is identical to the second selected geometry of the second lateral surface of at least one of the tool lower part and the tool upper part.

8. The modular die according to claim 1, wherein the first selected geometry of the first lateral surface of at least one of the tool lower part and the tool upper part is different from the second selected geometry of the second lateral surface of at least one of the tool lower part and the tool upper part.

9. The modular die according to claim 1, wherein the position of insertion of the at least one of a tool lower part and a tool upper part into the gap is the same as the position of extraction of the at least one of the tool lower part and tool upper part from the gap, and wherein the geometry of the at least one first fixation part is selected from the following geometries: a convex surface or a concave surface, wherein the geometry of part of the first lateral surface of at least one of the tool upper part or the tool lower part is selected from the following geometries: a concave surface, or a convex surface, so that the at least one of a tool lower part and a tool upper part at the distant position is fixed to one of the frame lower part and frame upper part, at least in a direction along a direction of insertion into or extraction from the gap between the frame upper part and the frame lower part, and wherein the geometry of the at least one second fixation part is selected from the following geometries: a convex surface or a concave surface, wherein the geometry of part of the second lateral surface of at least one of the tool upper part or the tool lower part is selected from the following geometries: a concave surface or a convex surface, so that the at least one of a tool lower part and a tool upper part at the proximate position is fixed to one of the frame lower part and frame upper part, both in a direction along, and in a direction transverse to, a direction of insertion into or extraction from the gap between the frame upper part and the frame lower part.

10. The modular die according to claim 1, wherein the die comprises a linear safety pillar capable of extending between the frame lower part and the frame upper part, and the safety pillar capable of being applied to the die, and capable of being left out of the die, by choice of an operator, the safety pillar, when applied to the die, extending between the frame lower part and the frame upper part;

the safety pillar, when applied to the die, operating a stop pin, preventing the stop pin from entering into a corresponding recess in the at least one second fixation part, allowing the at last one second fixation part to displace from the closed position to the open position, allowing the at least one of a tool lower part and tool upper part to be inserted into, or to be extracted from, the gap between the frame lower part and the frame upper part;

the safety pillar, when not applied, not operating the stop pin, allowing the stop pin to enter into the corresponding recess in the at least one second fixation part, preventing the at least one second fixation part to displace from the closed position to the open position, preventing the at least one of a tool lower part and a tool upper part from being inserted into, or being extracted from, the gap between the frame lower part and the frame upper part; and wherein the safety pillar is intended for being applied, by an operator, when the at least one of a tool lower part and a tool upper part are to be inserted into, or are to be extracted from, the gap between the frame lower part and the frame upper part, and the safety pillar intended for being left out during manufacture of blanks in the die.

11. The modular die according to claim 10, wherein the stop pin is biased, by a resilient element, towards a position, where the stop pin extends into the corresponding recess in the at least one second fixation means; and wherein the safety pillar, when applied to the die, biases the stop pin against the biasing by the resilient element with a force larger than a biasing force of the resilient element.

12. A use of the modular die according to claim 1, said use comprising steps of positioning the frame lower part at the lower bed of a press, supporting the tool lower part on the frame lower part, positioning a strip of blank in a gap between the tool lower part and the tool upper part, displacing the frame upper part by the ram of a press downwards towards the frame lower part so that the tool upper part is displaced downwards towards the tool lower part, thereby manufacturing one of the following individual blanks: a brake shim, a gasket.

* * * * *